US007335173B2

(12) United States Patent
Swidler

(10) Patent No.: US 7,335,173 B2
(45) Date of Patent: Feb. 26, 2008

(54) IMPACT TABLE SYSTEM AND METHOD

(76) Inventor: Steven A. Swidler, 4650 W. Jojoba Dr., Tucson, AZ (US) 85745

( * ) Notice: Subject to any disclaimer, the term of this patent is extended or adjusted under 35 U.S.C. 154(b) by 78 days.

(21) Appl. No.: 11/107,429

(22) Filed: Apr. 15, 2005

(65) Prior Publication Data

US 2005/0182343 A1 Aug. 18, 2005

Related U.S. Application Data

(63) Continuation-in-part of application No. 10/159,854, filed on May 31, 2002.

(51) Int. Cl.
*A61H 23/02* (2006.01)

(52) U.S. Cl. ..... 601/100; 601/98; 601/101

(58) Field of Classification Search ..... 601/23, 601/24, 26, 46, 49, 51, 52, 86, 87, 98, 100, 601/101, 107, 108; 606/240; 5/611, 612
See application file for complete search history.

(56) References Cited

U.S. PATENT DOCUMENTS 4,958,627 A * 9/1990 Park ..... 601/49
5,626,555 A * 5/1997 Di Blasi et al. ..... 601/98

* cited by examiner

*Primary Examiner*—Quang D. Thanh
(74) *Attorney, Agent, or Firm*—Leydig, Voit & Mayer, Ltd.

(57) ABSTRACT

An impact table includes a table sufficiently large to support a person. The table has a drive plate engagement portion on a bottom portion of the table. A drive system comprises a drive plate having an engagement portion mechanically disposed on the drive plate. The drive plate has at least one inclined plane portion such that as the drive plate rotates, the drive plate engagement portion rises and falls upon the drive plate. An axle couples the drive plate to a drive motor such that the drive plate rotates as the drive motor rotates the axle.

16 Claims, 5 Drawing Sheets

Fig. 7
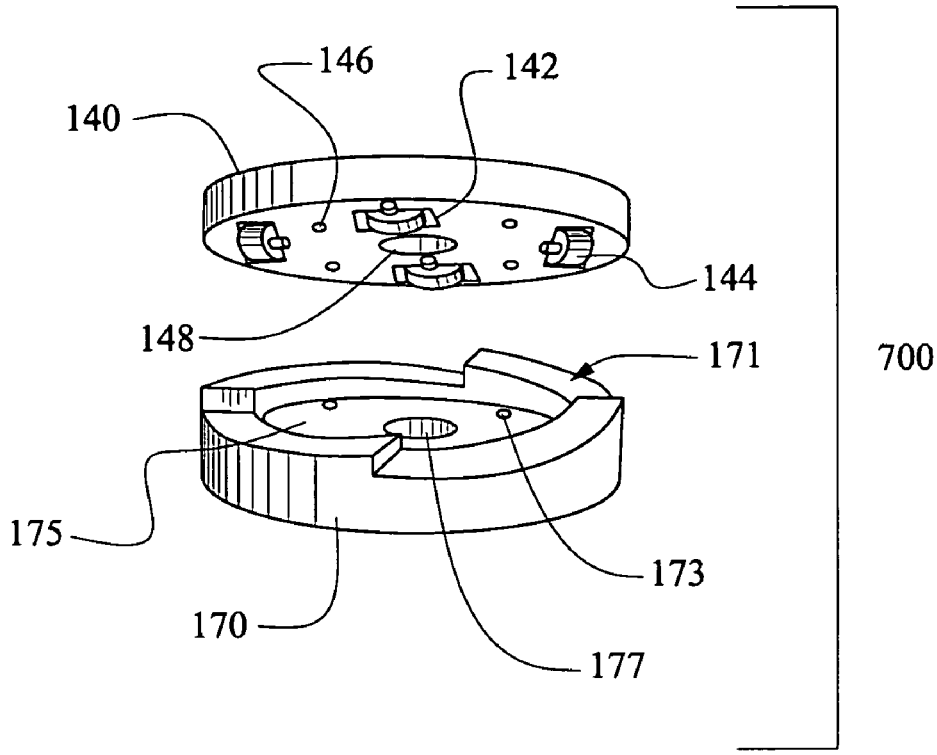
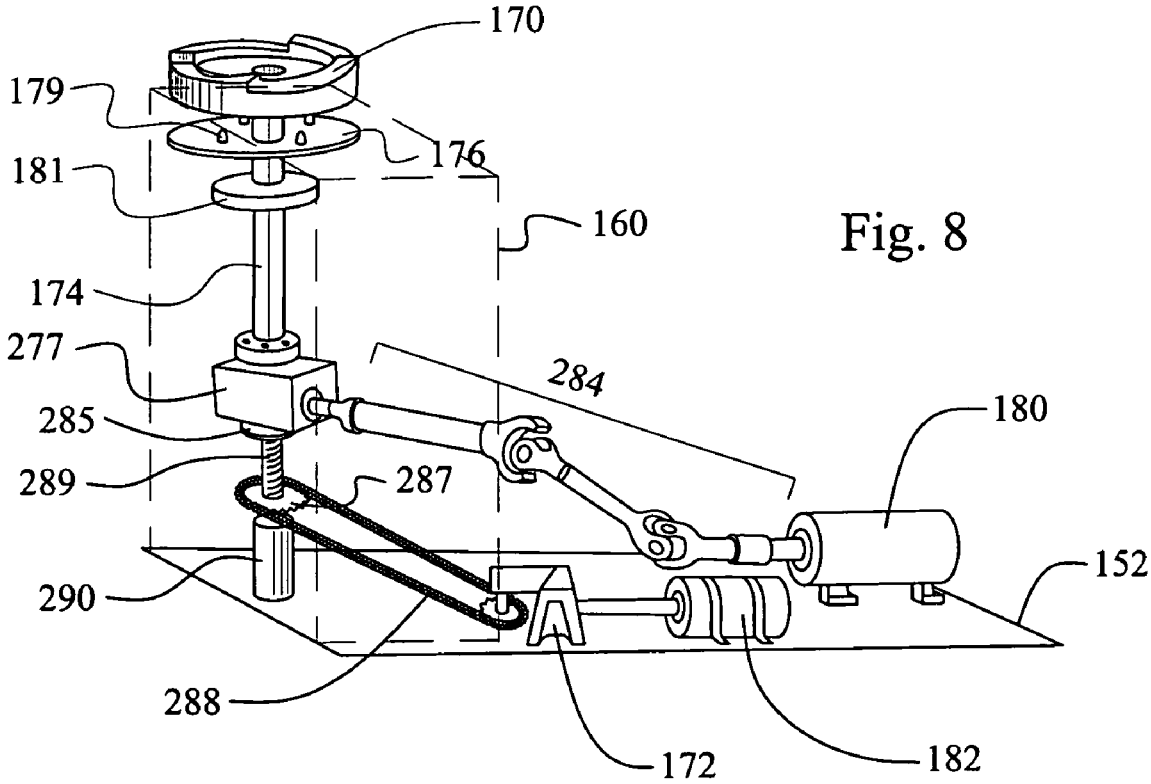
Fig. 8

IMPACT TABLE SYSTEM AND METHOD

CROSS REFERENCE TO RELATED APPLICATION

This application is a continuation in part of and claims priority from U.S. patent application Ser. No. 10/159,854 entitled IMPACT TABLE SYSTEM AND METHOD by Steven Swidler, filed on 31 May 2002.

TECHNICAL FIELD

Generally, the invention relates healthcare facilities such as spas, wellness centers, rehabilitation, and chiropractic centers. More particularly, the invention relates to devices that promote health.

STATEMENT OF A PROBLEM ADDRESSED BY THIS INVENTION

Many persons experience soft tissue strains due to minor or severe trauma, such as falls, or an auto accident. Many other people experience injuries due to repetitive traumas that are practically unnoticeable from day-to-day, but have a cumulative effect that results in physical pain and discomfort.

Injuries can displace, shorten, or twist connective tissue, which can decrease range of motion and/or function, decrease blood flow or lymphatic drainage, and cause other health and comfort issues. One result of these issues is that affected areas and systems do not function optimally. For example, normal body function by the lymph system (such as the removal of toxins), or the normal blood flow can be inhibited by these restrictions. On a more conscious level, a patient may feel discomfort or restriction, sometimes at the point of displacement, and sometimes in seemingly unrelated locations. For example, a pull in the chest may not only result in chest pain, but also in back pain, neck pain, or headaches.

What is needed is a device that relaxes and unwinds soft tissue injury and strain patterns, which invites balanced alignment, and balances fluid motion globally (in the entire body) to bring about stabilizing changes in body alignment and soft-tissue position.

BRIEF DESCRIPTION OF THE DRAWINGS

Various aspects of the invention, as well as an embodiment, are better understood by reference to the following EXEMPLARY EMBODIMENT OF A BEST MODE. To better understand the invention, the EXEMPLARY EMBODIMENT OF A BEST MODE should be read in conjunction with the drawings in which:

FIG. 7 is a close-up of the lift plate system; and

FIG. 8 provides additional detail of the drive system.

AN EXEMPLARY EMBODIMENT OF A BEST MODE

Figure 1:
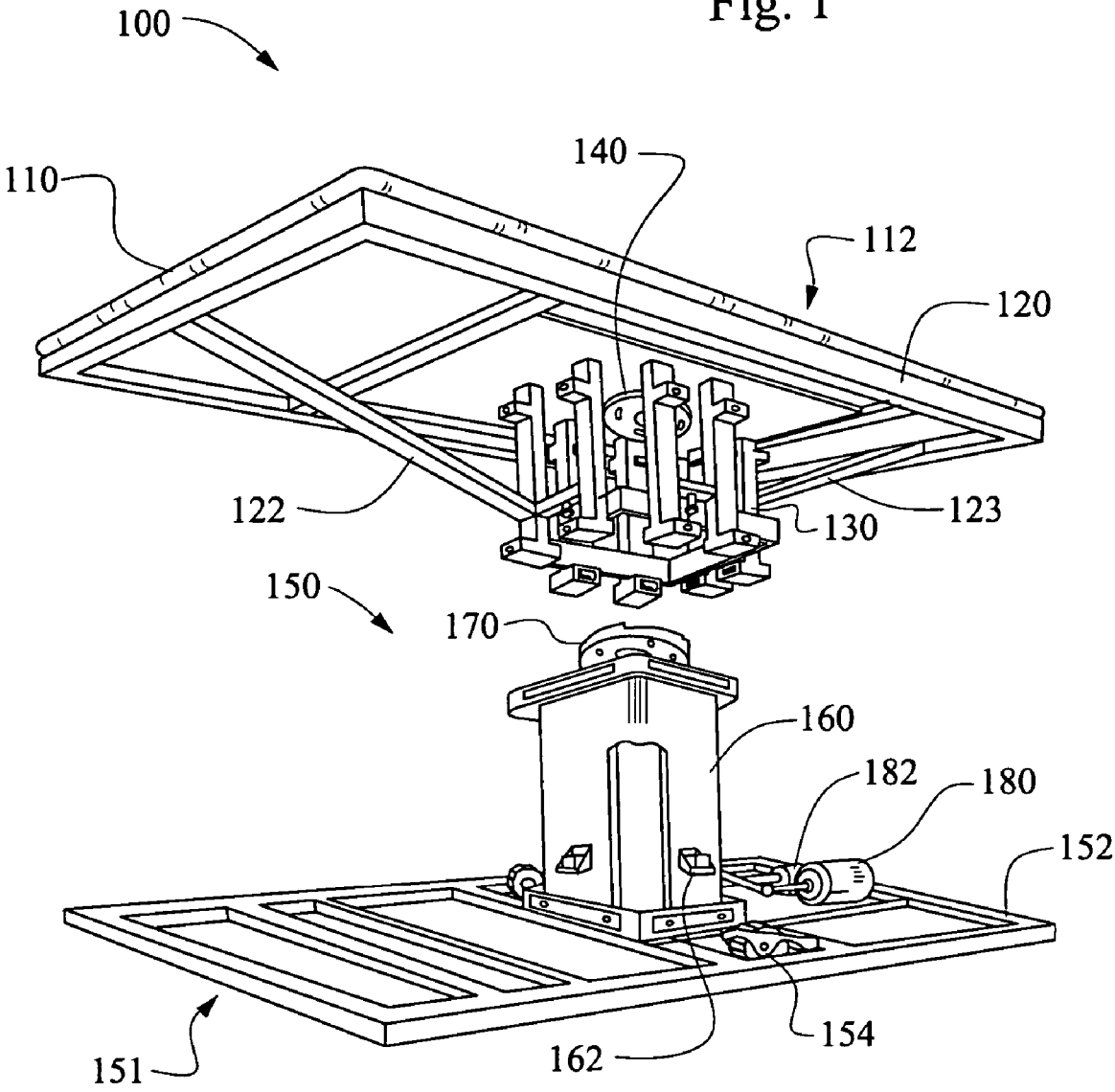
FIG. 1 illustrates a partially disassembled impact table.

The invention teaches an impact table, and method of using an impact table. The impact table utilizes a table as a point source of an impact wave. From another aspect, the table induces a pulse across an entire body at a single instance in time, thus affecting all parts of the body simultaneously. Preferably, the impact table creates an impact wave that acts globally on a body, at a single instance in time, which may be repeated at a desired frequency.

This has numerous implications for relaxing and unwinding soft tissue injury and strain patterns, which invites balanced alignment, and balances fluid motion globally (in the entire body) to bring about stabilizing changes in body alignment and soft-tissue position, and also has implications for a person whose jaw is out of alignment. For example, one common malalignment of jaw/bite relationships is TMJ (Tempero Mandibular Joint) dysfunction. Jaw malalignment can be complicated or affected by other jaw-related problems including neck aches, shoulder, or even a high hip position that can sometimes be traced to an out-of-alignment jaw. The impact table is particularly useful as a device that promotes balanced body/jaw alignment before dental stabilization.

Interpretation Considerations

When reading this section (An Exemplary Embodiment of a Best Mode, which describes an exemplary embodiment of the best mode of the invention, hereinafter "exemplary embodiment"), one should keep in mind several points. First, the following exemplary embodiment is what the inventor believes to be the best mode for practicing the invention at the time this patent was filed. Thus, since one of ordinary skill in the art may recognize from the following exemplary embodiment that substantially equivalent structures or substantially equivalent acts may be used to achieve the same results in exactly the same way, or to achieve the same results in a not dissimilar way, the following exemplary embodiment should not be interpreted as limiting the invention to one embodiment.

Likewise, individual aspects (sometimes called species) of the invention are provided as examples, and, accordingly, one of ordinary skill in the art may recognize from a following exemplary structure (or a following exemplary act) that a substantially equivalent structure or substantially equivalent act may be used to either achieve the same results in substantially the same way, or to achieve the same results in a not dissimilar way.

Accordingly, the discussion of a species (or a specific item) invokes the genus (the class of items) to which that species belongs as well as related species in that genus. Likewise, the recitation of a genus invokes the species known in the art. Furthermore, it is recognized that as technology develops, a number of additional alternatives to achieve an aspect of the invention may arise. Such advances are hereby incorporated within their respective genus, and should be recognized as being functionally equivalent or structurally equivalent to the aspect shown or described.

Second, the only essential aspects of the invention are identified by the claims. Thus, aspects of the invention, including elements, acts, functions, and relationships (shown or described) should not be interpreted as being essential unless they are explicitly described and identified as being essential. Third, a function or an act should be interpreted as incorporating all modes of doing that function or act, unless otherwise explicitly stated (for example, one recognizes that "tacking" may be done by nailing, stapling, gluing, hot gunning, riveting, etc., and so a use of the word tacking invokes stapling, gluing, etc., and all other modes of that word and similar words, such as "attaching").

Fourth, unless explicitly stated otherwise, conjunctive words (such as "or", "and", "including", or "comprising" for example) should be interpreted in the inclusive, not the exclusive, sense. Fifth, the words "means" and "step" are provided to facilitate the reader's understanding of the invention and do not mean "means" or "step" as defined in §112, paragraph 6 of 35 U.S.C., unless used as "means for -functioning-" or "step for -functioning-" in the Claims section. Sixth, the invention is also described in view of the Festo decisions, and, in that regard, the claims and the invention incorporate equivalents known, unknown, foreseeable, and unforeseeable. Seventh, the language and each word used in the invention should be given the ordinary interpretation of the language and the word, unless indicated otherwise.

Some methods of the invention may be practiced by placing the invention on a computer-readable medium. Computer-readable mediums include passive data storage, such as a random access memory (RAM) as well as semi-permanent data storage such as a compact disk read only memory (CD-ROM). In addition, the invention may be embodied in the RAM of a computer and effectively transform a standard computer into a new specific computing machine.

Data elements are organizations of data. One data element could be a simple electric signal placed on a data cable. One common and more sophisticated data element is called a packet. Other data elements could include packets with additional headers/footers/flags. Data signals comprise data, and are carried across transmission mediums and store and transport various data structures, and, thus, may be used to transport the invention. It should be noted in the following discussion that acts with like names are performed in like manners, unless otherwise stated.

Of course, the foregoing discussions and definitions are provided for clarification purposes and are not limiting. Words and phrases are to be given their ordinary plain meaning unless indicated otherwise.

DESCRIPTION OF THE DRAWINGS

FIG. 1 shows an impact table with a top portion 100 separated from a bottom portion 150 to ease the understanding of the following discussion. The top portion 100 includes a table 110 coupled to a table frame 120. The table 110 may be constructed of a solid material, such as a metal plate, or may comprise a more traditional medical table, including a plywood-table-padding-cover combination. The present table 110 includes a padding 112. Of course, table surfaces, table structure, paddings, and mattresses are well known in the chiropractic table arts, and paddings/mattresses known, foreseeable, and unforeseeable are encompasses within the scope of the invention.

The table frame 120 provides structural support, durability, and longevity to the impact table. The frame comprises various support members underneath and coupled to the table, as well as a first table brace 122 and a second table brace 123 that couple the table 110 to a table stabilization system. A table stabilization system provides lateral stability and control to the table 110. The table stabilization system is coupled to the table 110 such that the table 110 is laterally supported in operation. In one embodiment, the table stabilization system comprises at least four pedistal support members 130 (eight pedistal support members 130 are shown here) coupled to a bottom portion of the table 110, and being arranged outside of a pedistal 160 that encloses a drive system. Also coupled to the table 110 is a drive plate engagement portion 140 (discussed below), here shown as a table plate, which may also be coupled to the table 110 via the frame 120. Viewed another way, in an alternative embodiment of the invention the table frame 120 coupled between a bottom portion of the table 110 and the drive plate engagement portion 140.

The bottom portion 150 is shown having a floor frame 151 that supports a drive pedistal (pedistal) 160, the pedistal 160 enclosing drive system that rotates a drive plate 170 that engages the table plate. The pedistal 160 has a plurality of feet 162, at least one foot 162 that indirectly supports the table 110, here via the table stabilization system 130 and table braces 122, 123. Additionally, mobility wheels 154 are disposed in the frame 151 so that the impact table may be more easily transported. The functionality of an elevation motor 182 is discussed below.

Accordingly, in one embodiment the invention comprises a table sufficiently large to support a person, the table comprising a drive plate engagement portion 140 on a bottom portion of the table 110. The invention also includes a drive system that includes a drive plate 170. Thus, in operation to cause an impact wave, the drive plate engagement portion 140 is mechanically disposed upon the drive plate 170. In addition, the drive plate 170 has at least one inclined plane portion such that as the drive plate rotates, the drive plate engagement portion 140 rises and falls upon the drive plate 170, as described below.

Figure 2:
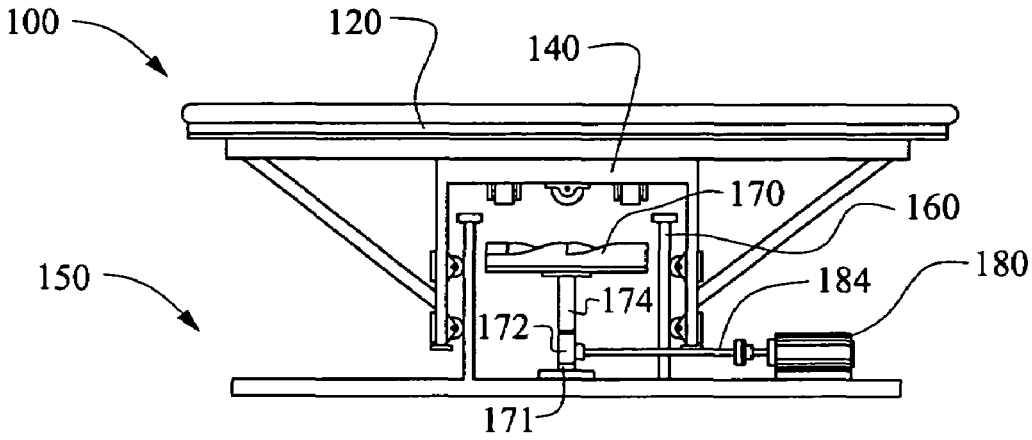
FIG. 2 shows a cut view of the assembled impact table.

FIG. 2 shows a cut view of the assembled impact table. It is seen that within the drive pedistal 160 an axel 174 couples the drive plate 170 to a drive motor 180 for rotating the axel 174 such that as the drive motor 180 rotates the axel 174, the drive plate 170 rotates. Note that FIG. 2 shows an alternative embodiment of a drive system including a drive motor 180, drive axel 184 and gear box 172 that transfers the rotational energy of the drive axel 184 into rotational energy for the axel 174. A lift member 171, such as a gearbox, raises and lowers at least the drive plate 170 of the drive system via the elevation motor 182. Collectively, the lift member 171 and drive plate 170 comprise an engagement system. Although many variations of an engagement system are readily apparent to those of skill in the art upon reading this disclosure, one alternative embodiment of an engagement system is discussed below.

Figure 3:
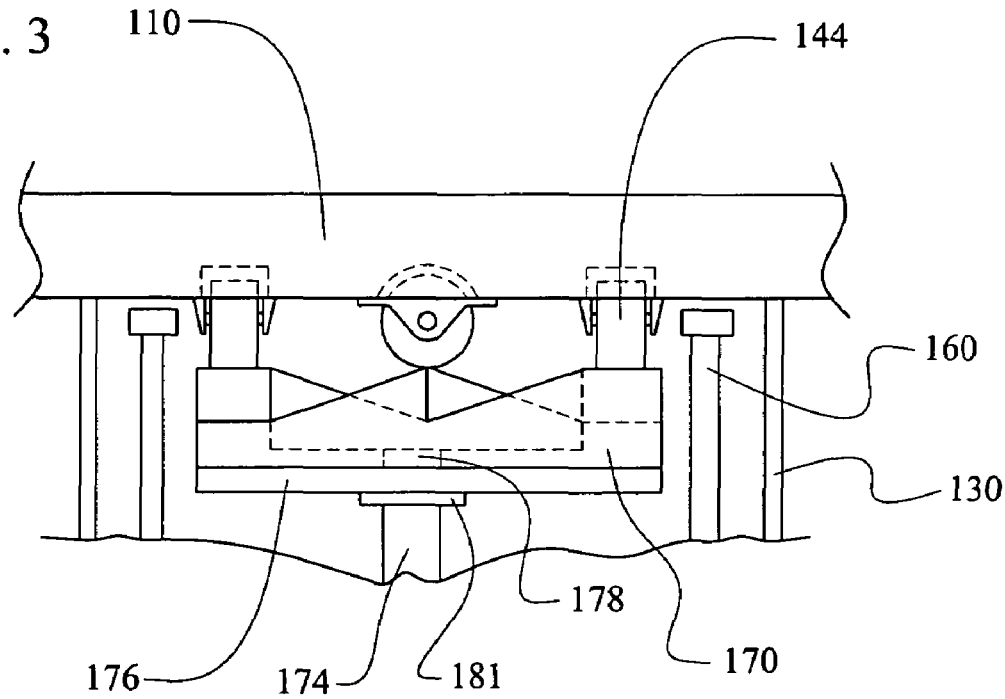
FIG. 3 is a close-up of the lift system of the impact table.

FIG. 3 is a close-up of a lift system of an impact table. The lift system generally comprises a drive plate 170 and a drive plate engagement portion 140. Here, the drive plate engagement portion is embedded directly in the table 110. In this embodiment, the drive plate engagement portion can be characterized as a table plate embedded or integrally formed with the table 110. From this view, one can more clearly see that the drive plate engagement portion 140 comprises a plurality of wheels 144. Preferably four wheels are provided, and the drive plate 170 preferably has four corresponding inclined planes (discussed in further detail below). In addition, the drive plate 170 is more clearly seen to be rotatable in the drive pedistal 160, and that the drive plate 170 is coupled to the axel 174 via a drive plate mounting 178 that fits within a centered hole in the drive plate 170, a drive plate coupling 176 that supports the weight of the drive plate 170, and an axial mounting 181, which promotes the rotation of the drive plate coupling 176. The drive plate 170, the drive plate coupling 176, and the axial mounting 181 are discussed in further detail below.

Figure 4:
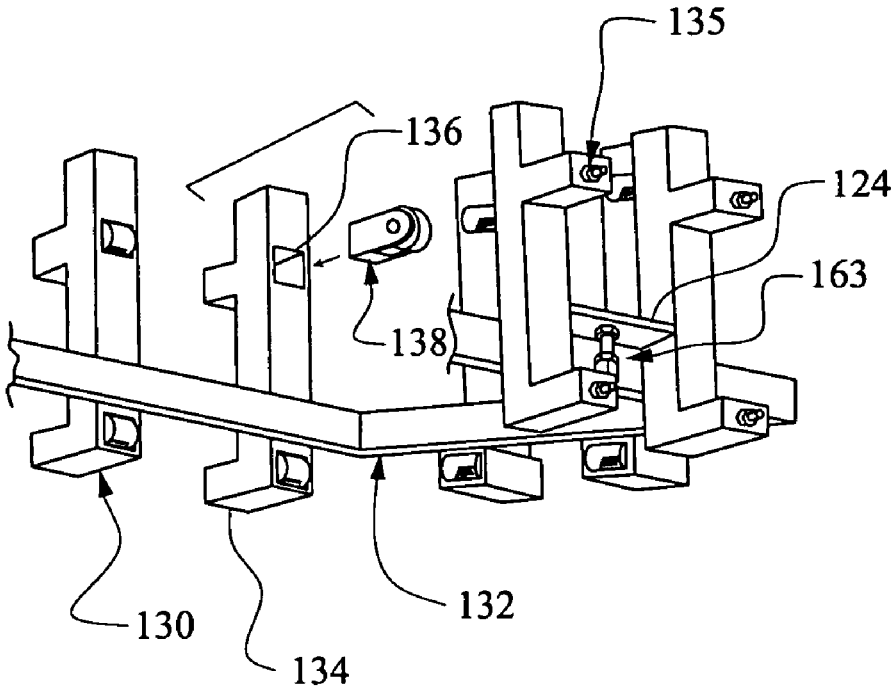
FIG. 4 illustrates a table stabilization system.

FIG. 4 illustrates a table stabilization system. The table stabilization system comprises a plurality of lateral supports 130. Although only three lateral supports are needed to support a table upon a round pedistal, and only four lateral supports are needed to support a table upon a square pedistal, a preferred embodiment of the invention utilizes eight lateral supports 130 to robustly secure top portion 100 to the bottom portion 150. Each of the lateral supports 130 comprises two wheel mount recesses 134, which maintain hollow wheel mounts 136 into which a wheel and axel system 138 is secured. Although not shown, each wheel mount recess 134 has a hole, and each wheel and axel system 138 includes bolt 135 on the back. The bolt 135 fits through the hole and secures the wheel and axel system 138 in the wheel mount 136 with a common bolt and washer. Collectively, the lateral supports 130 are secured to a brace 132 (the brace being shaped like the exterior of the pedistal 160). However, it is preferred that the wheels of the wheel and axel system 138, when mounting in the wheel mounts 136, extend slightly beyond the interior-most portion of the brace 132. Additionally, a lateral support brace 124, being a metal plate welded or otherwise rigidly attached between two lateral supports 130, provides a table brace mount 163.

Figure 5:
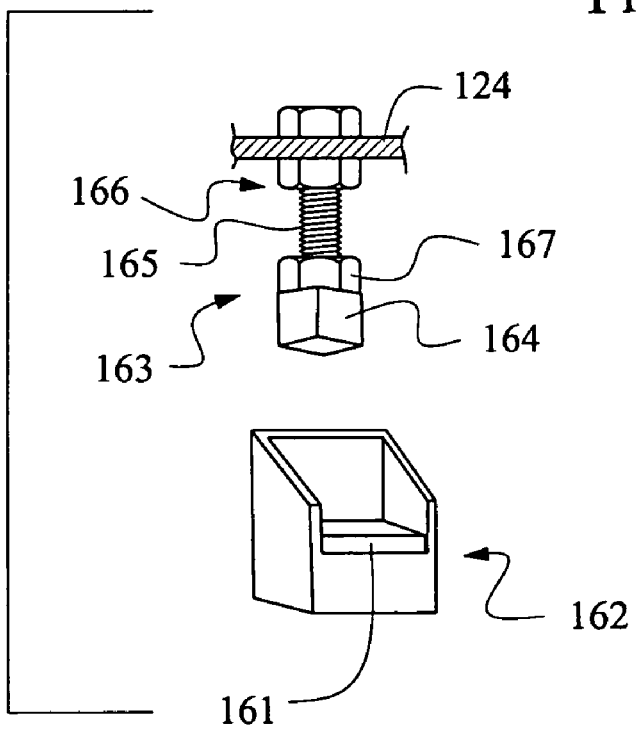
FIG. 5 is a close-up of the pedistal foot and table brace mount.

FIG. 5 is a close-up of the pedistal foot 162 and the table brace mount 163. The pedistal foot 162, which provides a stationary point for accepting a top portion 100 of the impact table, is securely attached to the pedistal 160, and may comprise a replaceable impact pad 161 for absorbing shock and for increasing the longevity of the impact table. The table brace mount 163 is rigidly coupled to the lateral support brace via locking bolts 166 and height-adjustable bolt 165. The bolt 165 has a bolt head 167, and includes a replaceable impact head 164 for absorbing shock and for increasing the longevity of the impact table. Accordingly in one embodiment, the top portion 100 rests on the bottom portion 150 via rubber-on-rubber touch points. Of course, it is understood by those of skill in the art that a great variety of top portion-bottom portion interfaces may be designed, and the present invention encompasses those foreseeable and unforeseeable.

Figure 6:
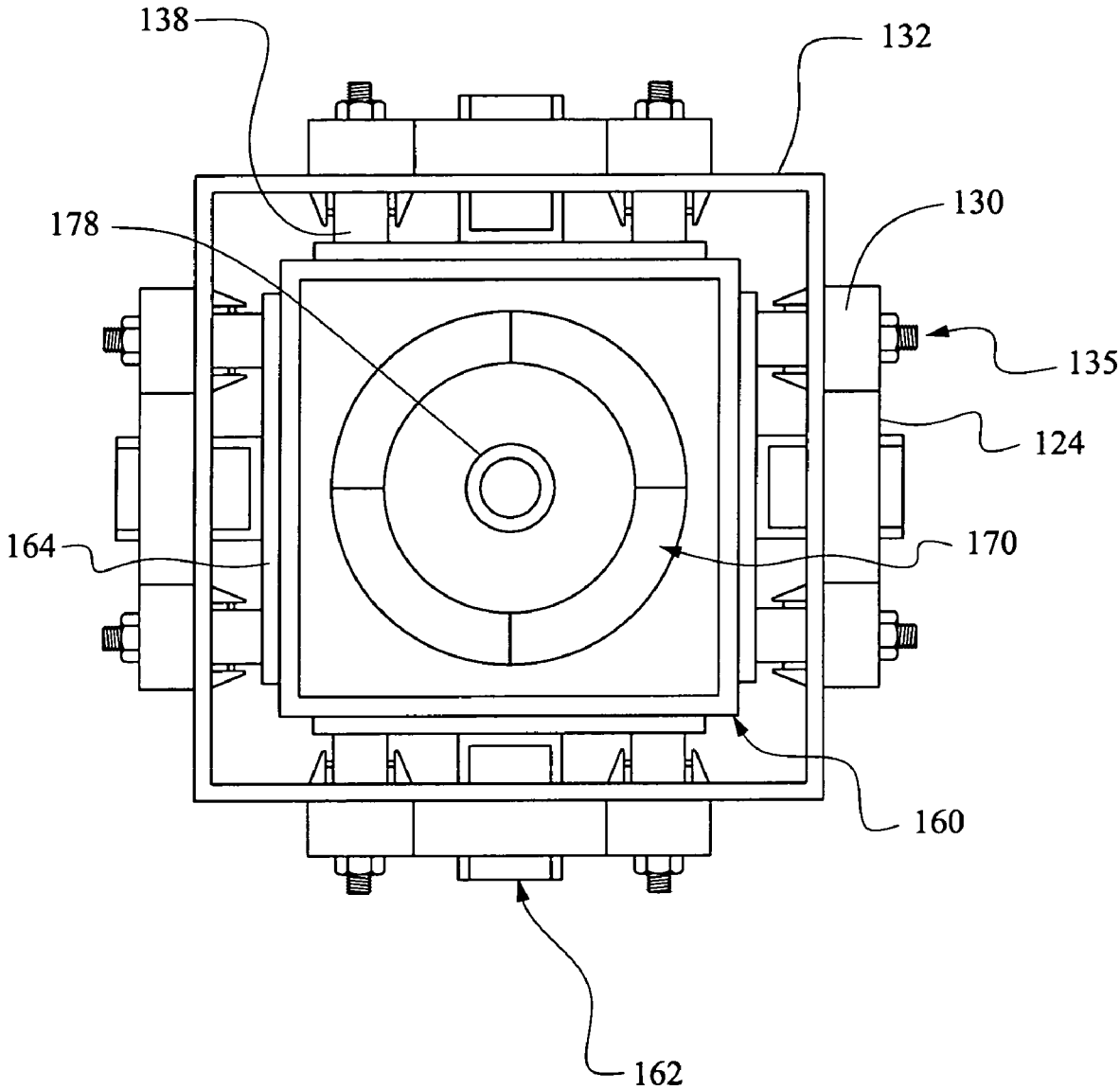
FIG. 6 shows a top-down view of the lift system and stabilization system.

FIG. 6 shows a top-down view of the lift system in combination of the stabilization system so that the interaction of the two systems may be more easily understood. A traction pad 164 is shown coupled to the pedistal 160. The traction pad 164 provides a slip-resistant surface upon which the wheels travel.

FIG. 7 is a close-up of the lift plate system 700, comprising the drive plate 170 and the drive plate engagement portion, shown here as a table plate 141. The table plate 141 includes a plurality of boltholes 146 for coupling the table plate 141 to a bottom portion of the table 110, or, alternatively, a table frame that supports a table. Additionally, the table plate 141 includes a mounting hole 148 that allows for the centering of the table plate 141 with the drive plate 170. Furthermore, four wheel recesses 142 each accept a wheel 144. Each wheel fits in each wheel recess such that the table plate 141 can rotate upon the drive plate 170, riding up each inclined plane 171, and then drop proximate to the low-point of the inclined plane without the table plate scraping the surface of an inclined plane 171 or any other portion of the drive plate 170.

The drive plate 170 is seen to comprise a plurality of inclined plane portions 171. Here, four inclined plane portions 171 are shown. However, other numbers of inclined plane portions may be used to achieve a desired result. Such number of inclined plane portions and the rotational velocity of the drive plate 170 together interact to provide a number of impact waves over time, or in other words, a frequency of impact waves. In addition, the height a wheel 144 of the drive plate engagement portion 140 rises and falls upon an inclined plane on the drive plate 170 defines an amplitude. From FIG. 7, one can clearly see the mounting hole 177, as well as knob holes 173.

FIG. 8 provides additional detail of a drive system, maintained within the pedistal 160. The drive system generally comprises those components that rotate the drive plate 170 (here, from a gearbox 277 to the drive plate 270). Here, the drive plate 170 is shown slightly elevated from the drive plate coupling 176 to expose the drive plate mounting 178 (unnumbered in the drawings, but easily identified). The elevation of the drive plate 170 also allows one to see knobs 179 that laterally secure the drive plate 170 onto the drive system and facilitates rotation of the drive plate 170 by the axel 174. The knobs 179 may also be embodied as bolts, for example, as well as any other means known in the art, foreseeable and unforeseeable. The axial mounting 181 allows the drive plate mounting 176 to securely rest on the axial 174. Accordingly, in one embodiment, the axial mounting 181 is formed with the axial 174, while in other embodiments it is attached thereto in manners known in the art, foreseeable and unforeseeable.

The axial 174 couples to a rotating portion of the gear box 277 as known in the art. Similarly, the gear box is driven by a drive system 284, here shown as a plurality of drive arms, which are articulated by the drive motor 180, as is known in the art. Of course, a great many methods are known for imparting a rotational force on an axial, and all such methods (and their structural implementations) known, foreseeable and unforeseeable are incorporated within the scope of the invention. In FIG. 8, the gearbox 277 rests on a gearbox mount 285. The gearbox mount 285 includes a mounting system, here shown as a mounting plate, and a means for raising and lowering the mounting plate, such as a gearbox or threaded bolt portion 289.

Here, the mounting plate is raised and lowered by turning a chain-driven cog that rotationally secured to a base 290. Accordingly, the elevation motor 182 uses the gearbox 172 to drive a chain 288, which turns the cog 287 to either raise or lower the gearbox mount. A great many methods are known for raising and lowering a load, and all such methods (and their structural implementations) known, foreseeable and unforeseeable are incorporated within the scope of the invention.

Of course, other features may be added to the invention by adding a breaking system, shock absorbing system, computer controls, timers, and a great many other structures and electrical systems and electronic systems may be added to the invention without departing from its scope.

Exemplary Methods

The invention applies an impact wave to a user to effect changes in body alignment, to reduce soft-tissue strain patterns, and to balance body fluids. In practice, a recipient of an impact wave will experience relief of symptomology. In one embodiment, the invention is a method of inducing an impact wave underneath a table, where the table is sufficiently large to support a person lying down on the table. Thus, the entire table functions as a point source for the impact wave. In a preferred embodiment, an impact wave is created when a horizontal drive plate rotates to a position that allows the wheels under which it rotates to fall from the top of the inclined planes of the drive plate to the bottom of the inclined planes (or, proximate to the bottom; as obviously wheels will not fall exactly in the bottom-most portion of the inclined planes). In other words, the impact table falls from a first height to a second (lower) height, with a minimum of extraneous vibration (preferably none) and a minimum of lateral movement. Of course, a plurality of horizontal plates could be used so long as they are synchronized to allow the table to rise and fall as a single unit that maintains an approximately horizontal position.

The fall of the table upon the drive plate, or some other stationary object or generalized "point," generates an impact wave such that the table itself (preferably the entire table) functions as the point source of the impact wave. However, it is understood upon reading this disclosure that the impact wave may be generated upon a table frame that supports the table, or upon a number of other drive plate engagement portions foreseeable and unforeseeable. Accordingly, the impact wave is transferred to a recipient directly via the table, or a table mattress/other padding or table accessories known in the art, foreseeable, or unforeseeable. Thus, the impact wave is induced across an area approximately the size of a person via the impact table.

It is appreciated that the amplitude and frequency may be varied, and accordingly, a user (such as a doctor, chiropractor, assistant, or the person "riding" the table, for example) may set an amplitude, and provide multiple impact waves at a desired frequency, thus providing a pre-selected frequency and amplitude for the person riding the table. In a preferred embodiment, the amplitude may be varied by selecting a horizontal drive plate that induces a desired amplitude via the height of the inclined planes, and the frequency may be adjusted by adjusting the speed of rotation of the drive plate. Alternatively, adjusting the height of the table may also adjust the amplitude of each impact wave.

In one embodiment, the impact wave has a frequency of between 1 Hz and 100 Hz, and is preferably between 4 Hz to 15 Hz. Similarly, the preferred amplitude is ⅛ inch in height, but may be adjusted to be as short as mere micrometers that may barely be perceived by a user, or to amplitudes larger than ⅛ inch. Of course, it is readily apparent to those of ordinary skill in the art upon reading this disclosure that amplitude and frequency may be adjusted by many equivalent means, and such adjustments are incorporated within the teachings of the invention and the scope of the claims. Of interest, a user may assume any position as needed to most effectively treat the user as a whole, or for a specific injury.

Impact waves are preferably provided to a user for a pre-selected period of time. For example, when "testing" a user's tolerance for the impact waves, the impact table may operate for only a few seconds, such as 20 seconds. However, for treatment, more extended periods of exposure to the impact waves are preferred, such as between five minutes and thirty minutes of impact wave exposure. Preferably, a user is exposed to the impact waves for twenty to twenty five minutes. It is also preferable to set the time a user is exposed to the impact waves based on the user's injury/trauma, and the user's tolerance for the impact waves.

Of course, it should be understood that the order of the acts of the algorithms discussed herein may be accomplished in different order depending on the preferences of those skilled in the art, and such acts may be accomplished as software. Furthermore, though the invention has been described with respect to a specific preferred embodiment, many variations and modifications (including equivalents) will become apparent to those skilled in the art upon reading the present application. It is therefore the intention that the appended claims and their equivalents be interpreted as broadly as possible in view of the prior art to include all such variations and modifications.

I claim:

1. An impact table, comprising:

a table sufficiently large to support a person;

the table comprising a drive plate engagement portion on a bottom portion of the table;

a drive system comprising a drive plate, the drive plate engagement portion mechanically disposed upon the drive plate;

the drive plate having at least one inclined plane portion and at least one vertical plane portion such that as the drive plate rotates, the drive plate engagement portion rises along the at least one inclined plane portion and free-falls upon the drive plate beside the at least one vertical plane portion; and an axle that couples the drive plate to a drive motor for rotating the axle;

such that as the drive motor rotates the axle, the drive plate rotates.

2. The impact table of claim 1 further comprising a pedestal that encloses the drive system, and further comprising a table stabilization system, the table stabilization system coupled to the table such that the table is laterally supported by the pedestal.

3. The impact table of claim 2 wherein the table stabilization system comprises at least four pedestal support members coupled to the bottom of the table, and being arranged outside of a pedestal that encloses the drive system.

4. The impact table of claim 2 wherein the drive plate engagement portion comprises a plurality of wheels that allow the table to move up and down relative to the drive plate.

5. The impact table of claim 2 wherein the pedestal has a plurality of feet, at least one foot supporting the table via the table stabilization system.

6. The impact table of claim 1 further comprising a padding disposed on a top portion of the table.

7. The impact table of claim 1 further comprising a floor frame that supports a pedestal, the pedestal enclosing the drive system.

8. The impact table of claim 1 further comprising an engagement system, the engagement system comprising a motor, and a lift member, the lift member for adjusting the height of the drive plate.

9. The impact table of claim 1 wherein the drive plate engagement portion comprises a table plate.

10. The impact table of claim 9 wherein the table plate has a wheel for each inclined plane surface of the drive plate.

11. The impact table of claim 1 further comprising a gearbox that couples the drive motor to the axle.

12. The impact table of claim 1 further comprising a table frame coupled between the bottom portion of the table and the drive plate engagement portion.

13. The impact table of claim 1 further comprising a gearbox coupled between the axle and the drive motor.

14. An impact table, comprising:

a table surface adapted to entirely support a person lying prone;

a mechanism connected to the table surface, the mechanism including:

a rotating drive plate having a lift portion and a drop portion, and an engagement structure operably disposed to move the table surface, the engagement structure operating to lift the table surface when the engagement structure engages the lift portion, the engagement structure operating to drop the table surface in free-fall when the engagement structure engages the drop portion of the rotating drive plate, such that each drop operation is adapted to induce an impact wave across the entire body of the person lying on the table surface.

15. The impact table of claim 14, wherein the rotating drive plate rotates causing the engagement structure to alternately lift and drop the table surface at a selective frequency.

16. The impact table of claim 15, wherein the selective frequency is between 4 and 15 Hz.

* * * * *